United States Patent [19]

Gerlach et al.

[11] 4,035,984

[45] July 19, 1977

[54] WRAPPING METHOD AND APPARATUS

[75] Inventors: Carl J. Gerlach; Jerome Vande Castle, both of Green Bay, Wis.

[73] Assignee: FMC Corporation, San Jose, Calif.

[21] Appl. No.: 673,499

[22] Filed: Apr. 5, 1976

[51] Int. Cl.[2] ..... B65B 9/06

[52] U.S. Cl. ..... 53/28; 53/180 R; 53/182 R; 53/202

[58] Field of Search ..... 53/28, 180 R, 182, 202

[56] References Cited

U.S. PATENT DOCUMENTS

| | | | |
|---|---|---|---|
| 2,194,451 | 3/1940 | Soubier | 53/28 X |
| 3,760,559 | 9/1973 | Heinzer | 53/202 X |

*Primary Examiner*—Travis S. McGehee
*Attorney, Agent, or Firm*—A. J. Moore; C. E. Tripp

[57] ABSTRACT

A method and apparatus for packaging a twin row of articles in a web of wrapping material by moving longitudinally and transversely spaced pairs of articles along two rows onto a moving web of wrapping material which is then folded over the articles to form two parallel tubes of articles with the longitudinal edge portions and a central portion of the web disposed between the tubes. The edge portions are longitudinally sealed to the central portion, the central portion may then be longitudinally severed, and if severed the tubes of articles are thereafter transversely sealed and severed between entubed articles to form article filled packages at a rate in excess of about 400 packaged articles per minute. The web of wrapping material may be light paper which is sealed when cold, may be a web of thermosealing material which is sealed by heat and pressure, may be a web which is sealed by gluing, or may be a web having pre-printed pattern of pressure sensitive sealant which are mated and pressure sealed when cold.

18 Claims, 31 Drawing Figures

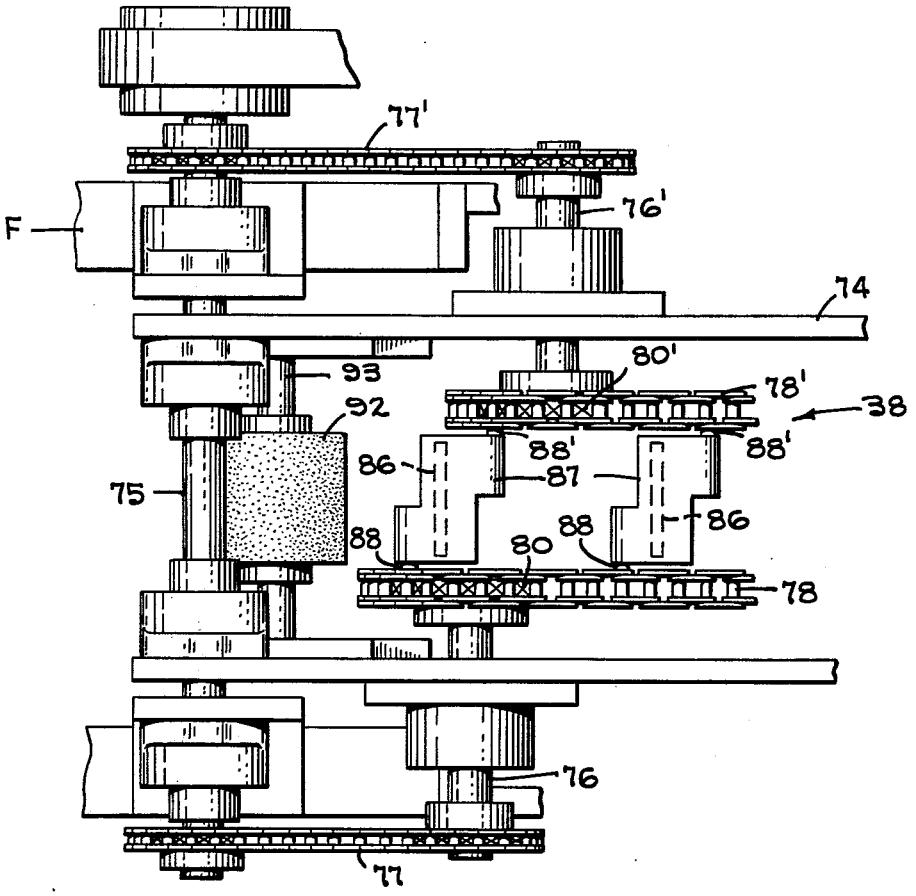
FIG_5
FIG_5A
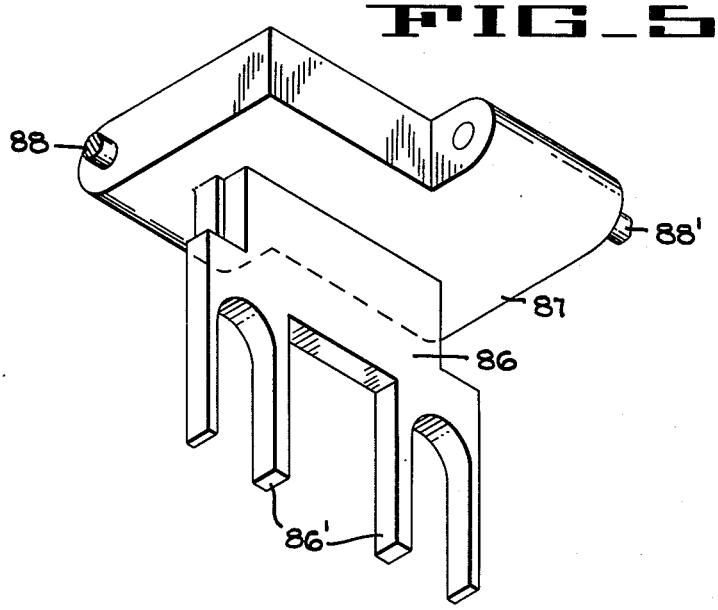

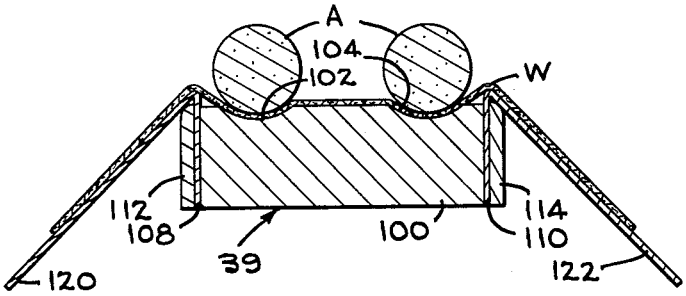
FIG_8
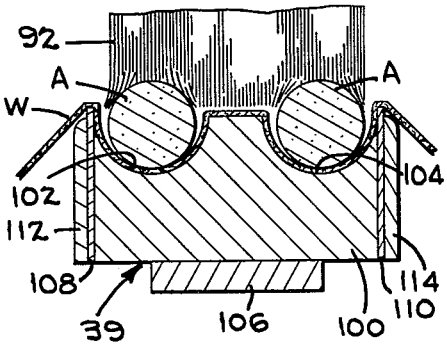
FIG_9
FIG_10
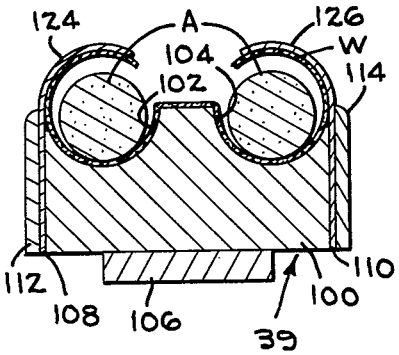
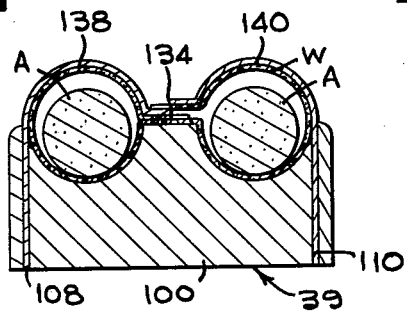
FIG_11
FIG_12
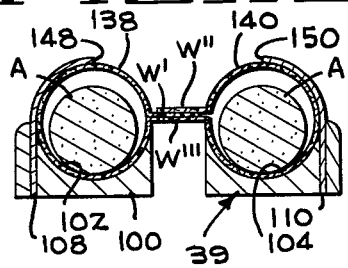
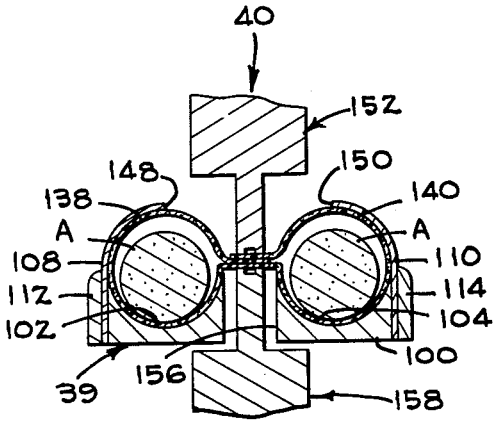
FIG_13
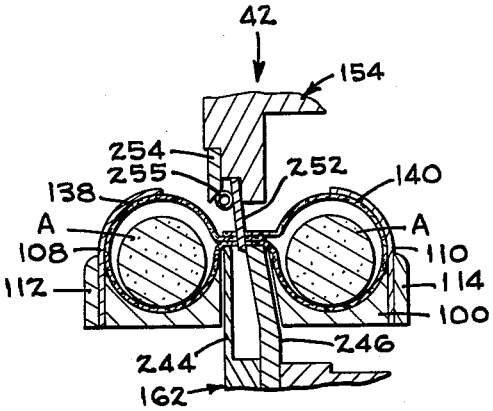
FIG_14

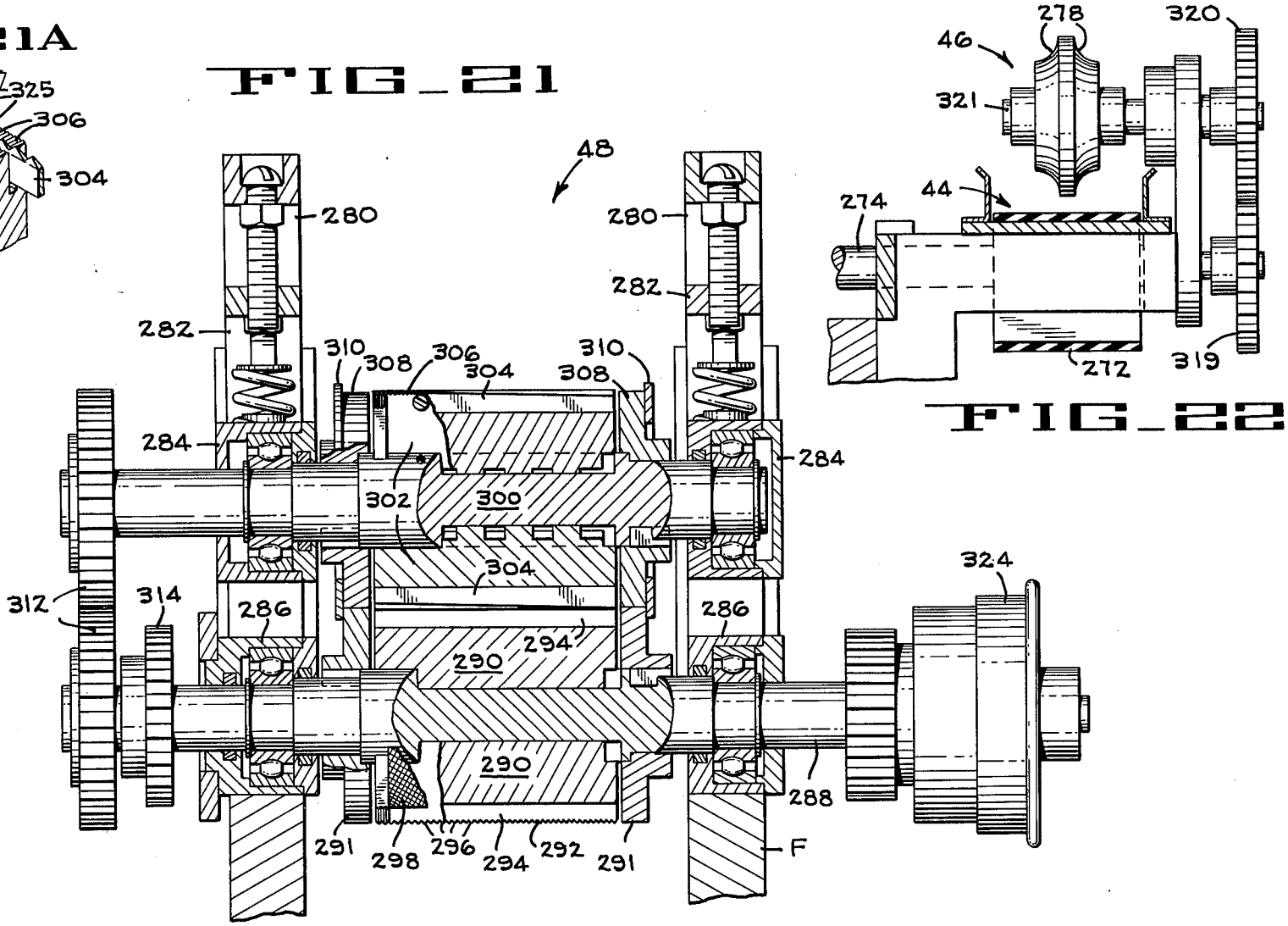
FIG_22
FIG_21
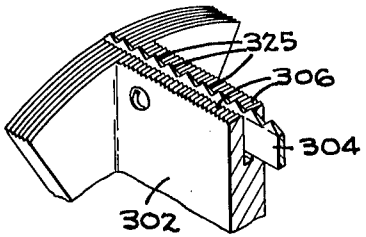
FIG_21A

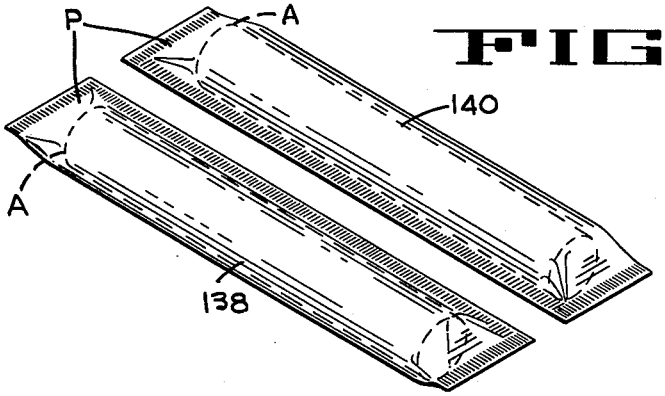
FIG_23
FIG_25
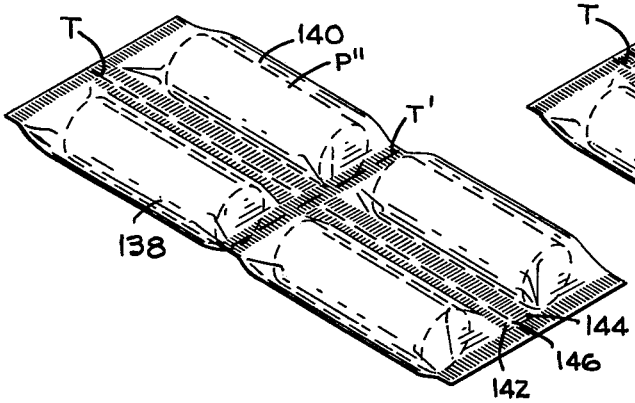
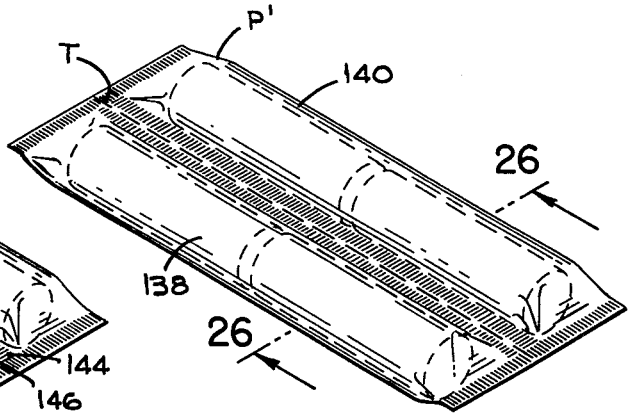
FIG_24
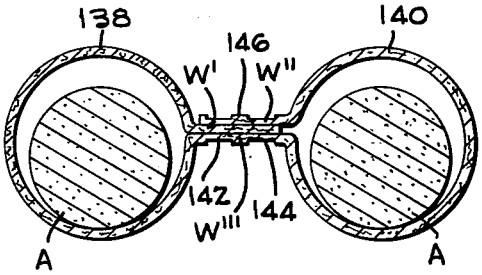
FIG_26
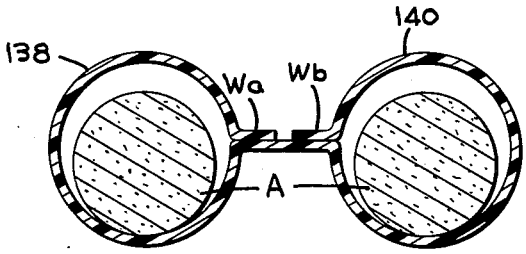
FIG_27

WRAPPING METHOD AND APPARATUS

CROSS REFERENCE TO RELATED APPLICATION

U.S. Aterianus Application Ser. No. 581,993 filed on May 29, 1975 and assigned to the assignee of the present invention is incorporated by reference herein and is pertinent in that it discloses drive mechanism of the type which may be used to drive the several components of the present machine.

BACKGROUND OF THE INVENTION

1. Field of the Invention

This invention pertains to wrapping machines and more particularly relates to high speed twin lane wrapping machines which simultameously entube pairs of transversely spaced articles in a web of wrapping material.

2. Description of Prior Art

Single lane wrapping machines such as disclosed in U.S. Pat. No. 2,882,662 to Campbell that issued on Apr. 21, 1959 are well known in the art. The Campbell wrapper lowers a web over a continuously moving row of spaced articles. The web is then folded under the articles and the overlapping edge portions are longitudinally heat sealed together by a rotary sealer to form a fin. The single tubular web is then transversely severed by rotary crimping and severing rolls of the type disclosed in Campbell U.S. Pat. No. 2,546,721 which issued on Mar. 27, 1951 or by the type of sealer disclosed in the aforementioned Aterianus application thereby providing individually packaged articles.

U.S. Pat. No. 2,565,444 to Waters which issued on Aug. 21, 1951 discloses a machine which receives a web of thermosealing wrapping material and forms upwardly opening W-shaped envelopes therein. Articles are dropped from a hopper into the two downwardly inclined envelopes which are thereafter longitudinally and transversely sealed. The so formed and filled packages are then longitudinally and transversely severed to provide a plurality of filled containers.

Another type of twin lane wrapping machine is disclosed in our U.S. Pat. No. 3,581,457 to Gerlach et al. which issued on June 1, 1971. This patent discloses a machine wherein a web of wrapping material is drawn downwardly over two rows or lanes of longitudinally and transversely spaced articles. The longitudinal edges of the web are then folded under the articles and are longitudinally heat sealed directly to a central portion of the web disposed between the rows of articles to provide two rows of entubed articles. The web may be longitudinally perforated to provide a tear strip prior to being folded and longitudinally sealed. The spaces between pairs of articles are thereafter transversely heat sealed by heat sealers on endless conveyors, are crimped, and are subsequently severed from the web to provide packages containing pairs of articles.

Heinzer U.S. Pat. No. 3,760,559 which issued on September 25, 1973 discloses a double lane wrapper wherein the web is moved downwardly over, not upwardly under, the articles. The longitudinal edges of the web are then folded under the articles, are longitudinally sealed and severed and are thereafter transversely sealed and severed.

Brook et al U.S. Pat. No. 3,110,142 which issued on Sept. 25, 1961 discloses a single lane, not a twin lane, wrapping machine which moves articles onto a web of material which is then formed into a tube by applying heat to the web. The tube is thereafter transversely severed and either twist sealed or heat sealed to seal each article in a separate package.

SUMMARY OF THE INVENTION

In general, the high speed twin lane wrapping machine of the present invention moves a web of wrapping material along an inclined path upwardly into supporting relationship with pairs of longitudinally spaced continuously moving articles that are positioned in two rows and are moving in the same direction but not necessarily at the same speed as the web. While continuously moving, the longitudinal portions of the web are folded over the articles with the longitudinal edge portions being disposed between the rows of articles and above a central portion of the web. A rotary longitudinal sealer then seals the edge portions to the central portion of the web thereby entubing the two rows of articles. Depending upon the type of package desired, a rotary longitudinal severing mechanism may be positioned to sever the sealed central portion of the web by either merely perforating the web to form a tear strip or by completely cutting through the web to form two separate longitudinally sealed tubes of articles. If a package having pairs of side by side articles therein is desired, the longitudinal severing mechanism is deactivated thereby omitting the longitudinal severing operation.

After the web with its entubed articles move past the longitudinal severing mechanism, the web enters a rotary transverse sealing and severing mechanism which, at least, transversely seals the web between spaced articles. The severing mechanism may be positioned to perforate or completely cut through each transversely sealed area, may be arranged to perforate or cut through every second transversely sealed area, or may be completely deactivated.

Although the preferred embodiment of the wrapping machine as disclosed herein is designed for use with light paper that is sealed by breaking the fibers in the paper and then interlocking the fibers, it will be understood that the machine may be easily modified to handle thermosealing or glue sealed webs. It will also be understood that a web having a pre-printed pattern of pressure sensitive sealant thereon may be pressure sealed with the subject apparatus when the material is cold.

Also, if it is desired to package the articles in printed or pattern coated webs, a well known continuous motion registration control system may be added to the apparatus to assure that the web is transversely sealed and/or severed at the proper place.

In accordance with the present invention a method of packaging articles comprises the steps of moving a web of packaging material having a longitudinal intermediate portion and edge portions along a path, moving a pair of spaced articles along spaced parallel paths onto the web for movement therewith, folding the web around the articles with the longitudinal edge portions disposed between the articles, longitudinally sealing the edge portions to the intermediate portion for encompassing each article in a tube of packaging material, and thereafter transversely sealing the tubes to confine the articles therein.

Further in accordance with the present invention, an apparatus for packaging articles into a web of packaging material having a longitudinal intermediate portion and longitudinally edge portions is provided comprising means for continuously moving the web along a path, means for moving pairs of spaced articles along two spaced parallel rows onto the web for movement therewith, folding means for receiving and folding the continuously moving web around the articles in each row with the longitudinal edge portions disposed between the articles, driven rotary means for longitudinally sealing the edge portions to the intermediate portions of the web for encompassing each row of articles in a tube of packaging material, and driven rotary transverse sealing means for thereafter transversely sealing the tubes with at least one article in each tube between adjacent transverse seals.

BRIEF DESCRIPTION OF THE DRAWINGS

FIG. 3 is an enlarged transverse section taken along lines 3—3 of FIG. 1 illustrating the twin lane article advancing run of an article receiving conveyor, and also illustrating a portion of an overhead article transfer conveyor.

FIG. 5A is a perspective view of one of the forked pusher plates of the overhed conveyor, used for moving articles onto the web wrapping material.

FIGS. 8–14 are transverse sections taken along the correspondingly numbered lines on FIG. 6 illustrating progressive stages in the web folding and article entubing operation.

FIG. 21 is a section taken along lines 21—21 of FIG. 19.

FIG. 21A is a perspective of a portion of the transverse cutting and sealing mechanism illustrating a toothed cutter for perforating the web and crimping teeth for transversely sealing the web.

FIG. 22 is a section taken along lines 22—22 of FIG. 19.

FIG. 23 is an enlarged perspective of a separated pair of paper packages as they leave the machine.

FIG. 24 illustrates a 4-pack that is perforated to provide a longitudinal tear strip with two short articles being entubed on each side of the tear strip.

FIG. 25 illustrates a 4-pack that is formed by a two headed transverse sealing and severing mechanism driven at twice the speed of the mechanism used to form the packages of FIGS. 23 and 24, said view further indicating that one head is provided with a severing blade that merely perforates while the blade of the other head completely severs the web.

FIG. 26 is an enlarged transverse section taken along lines 26—26 of FIG. 24 illustrating the preferred longitudinal seal area of a paper package with three layers of paper at the seal area.

FIG. 27 is a transverse section similar to FIG. 26 but illustrating the longitudinal seal area of a thermosealing (or pre-glued) web material which area includes only two thicknesses of packaging material to be sealed.

DESCRIPTION OF THE PREFERRED EMBODIMENT

Figure 2:
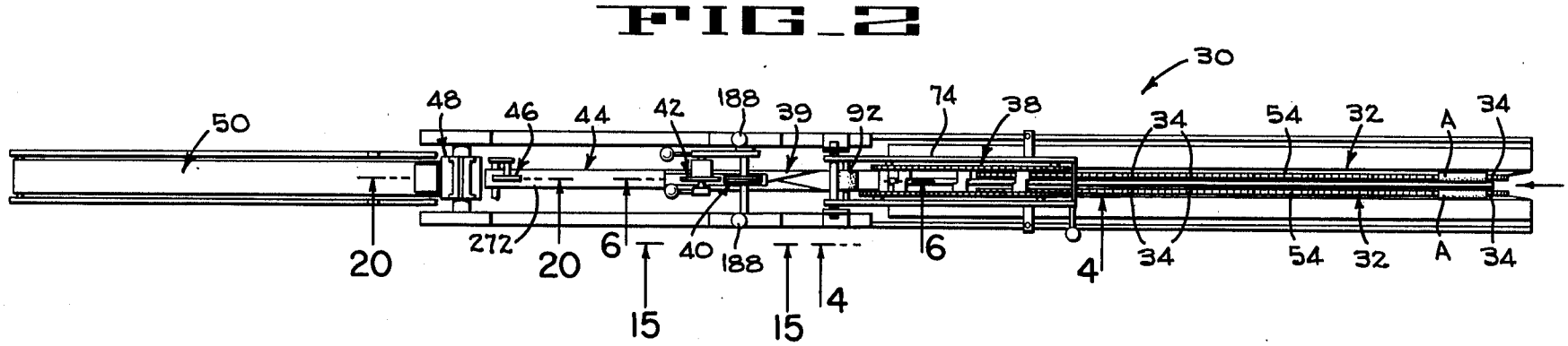
FIG. 2 is a diagrammatic plan of FIG. 1.

In general, the twin lane wrapping machine 30 (FIGS. 1 and 2) of the present invention comprises a pair of side-by-side article receiving or feed conveyors 32 having lugs 34 which advance pairs of longitudinally spaced articles A over a web W of wrapping material. In the illustrated preferred embodiment of the invention the wrapping material is light paper (12 lbs. sheet). However, it will be understood that the machine may be easily modified to handle other types of wrapping material such as thermosealing materials.

The web W is drawn from one of two rolls 36 supported by the frame F of the machine and moves upwardly in supporting engagement with the articles A which are transferred from the feed conveyors 32 onto the web by an overhead conveyor 38. A web former 39 then folds the longitudinal edge portions upwardly and around the articles (FIGS. 8–14) with the longitudinal edges being positioned above a central portion of the web and between the two rows of articles A. A rotary longitudinal sealing mechanism 40 (FIGS. 1 and 2) then longitudinally seals the edge portions through the central web portion to provide two lanes or rows of entubed articles A. A rotary longitudinal severing mechanism 42 follows the sealing mechanism 40 and may be selectively controlled to either completely sever the central portion of the web to provide two separated longitudinal tubes of articles; to longitudinally perforate the web W to provide interconnected tubes separated by a tear strip T (FIGS. 24 and 25), or may be inactivated to prevent longitudinal severance of the web. The entubed articles are then moved by a transfer conveyor 44 under a pressure wheel 46 which engages the longitudinally sealed area of the web to center and control the web as it is moved into a transverse cutting and sealing mechanism 48 which transversely seals and severs the web between the articles at spaced intervals along the web. The transverse severing mechanism may either perforate or completely cut through the web; or may be deactivated to retain the articles in long unsevered strips. The completed packaged articles are then discharged from the machine by a delivery conveyor 50 as separated packages P (FIGS. 23–25) or strip of packages.

More particularly, the feed conveyors 32 (FIGS. 3 and 4) include a pair of chains 54 trained around sprockets 56 (FIG. 1) secured to shafts journaled on the frame F. As illustrated in FIG. 3, the upper runs of the chains 54, and the evenly spaced lugs 34 thereon, are supported on a plate 60 secured to the frame F. A portion of the lugs 34 project upwardly through elongated slots in an article supporting plate 64, and push articles along spaced parallel paths defined by central guide rail 66 and side guide rail 68.

Figure 4:
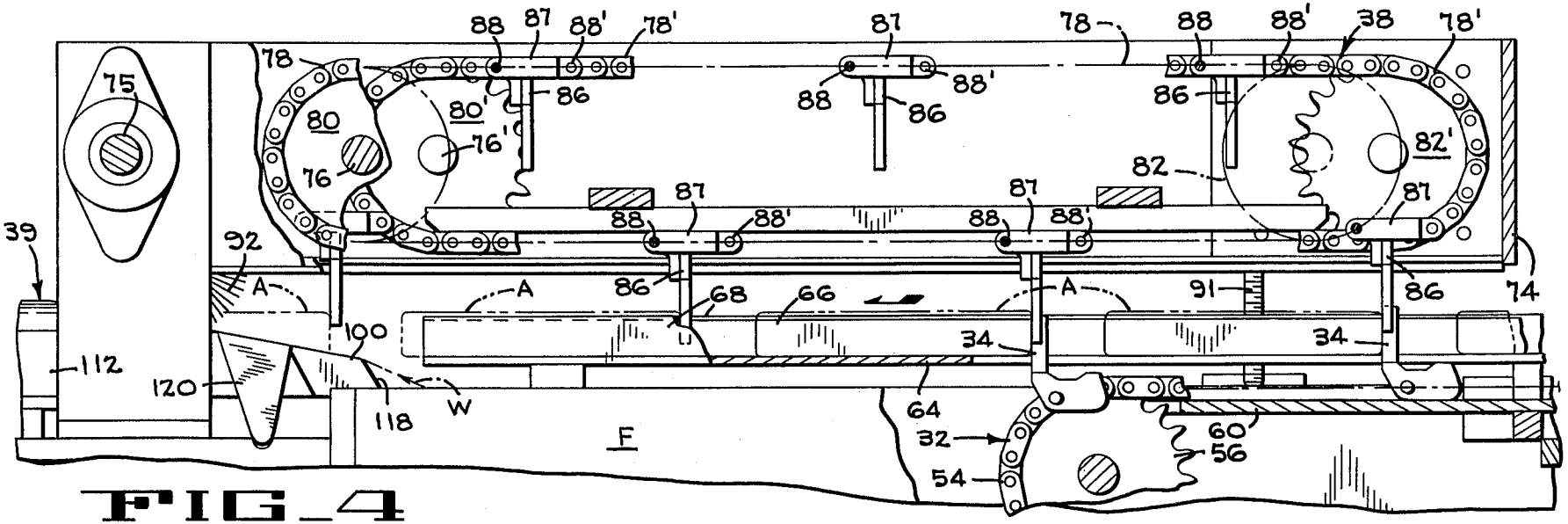
FIG. 4 is an enlarged vertical section taken along lines 4—4 of FIG. 2 illustrating the overhead article transfer conveyor as it cooperates with the article receiving conveyor for moving the twin lanes of articles from the receiving conveyor onto web of wrapping material as the wrapping material enters the web folding mechanism.
Figure 5:
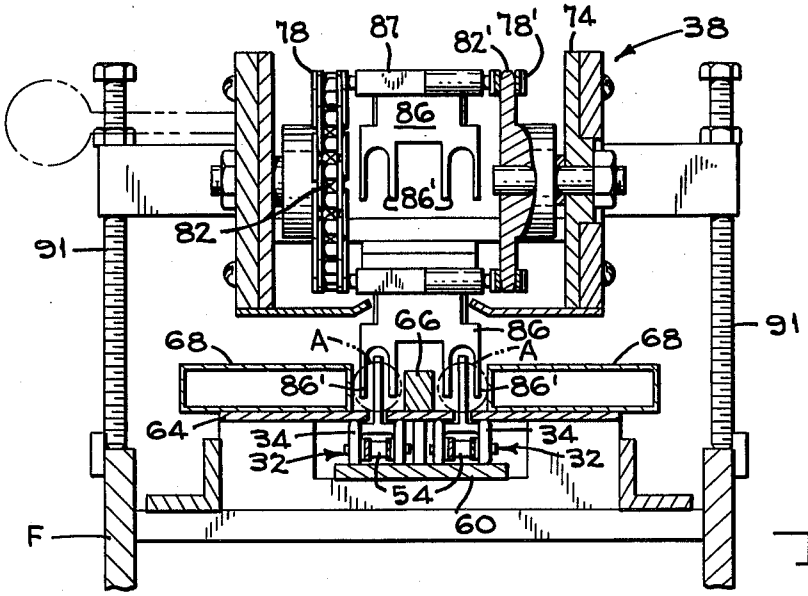
FIG. 5 is an enlarged plan taken looking in the direction of arrows 5—5 of FIG. 1 illustrating the forward portion of the overhead conveyor and an article hold-down brush.

The overhead conveyor 38 (FIGS. 3, 4 and 5) is mounted in a generally U-shaped sub-frame 74 pivoted to the main machine frame F near its downstream end on a driven shaft 75. The shaft 75 is connected to shafts 76 and 76' of the overhead conveyor 38 by chain drives 77, 77'. The conveyor 38 includes a pair of endless chains 78, 78' trained around sprockets 80, 80' on the offset shafts 76, 76' and around idler sprockets 82, 82' journaled on offset shafts 84, 84' secured in the sub-frame 74. A plurality of evenly spaced pusher plates 86 (FIGS. 3, 4 and 5A) are connected to the chain 78, 78' and have forked lower end portions 86' that are aligned with and straddle the upper portions of the lugs 34 of the feed conveyor 32 when near the discharge end of the feed conveyor. The pusher plates 86 (FIGS. 5 and 5A) are each secured to and project downwardly from a carrier 87 having pins 88, 88' projecting from opposite sides thereof and journaled in the conveyor chains 78, 78'. The pins 88, 88' are offset the same amount as the shafts 76, 76' and 78, 78' and therefore their pusher plates 86 remain vertical at all times during operation. As indicated in FIG. 4, the forked pusher plates 86 advance the articles A directly onto the web after the lugs 34 of the feed conveyor 32 move downwardly from the path of movement of the articles. It will be understood that the article contacting runs of the conveyors 32 and 38 are driven in the same direction and at the same speed by drive means similar to that disclosed in the aforementioned Aterianus application. However, the web W may be driven at the same speed or at a speed different from that of the conveyors 32 and 38 depending upon the type of article being packaged and the desired spacing between articles.

Figure 1:
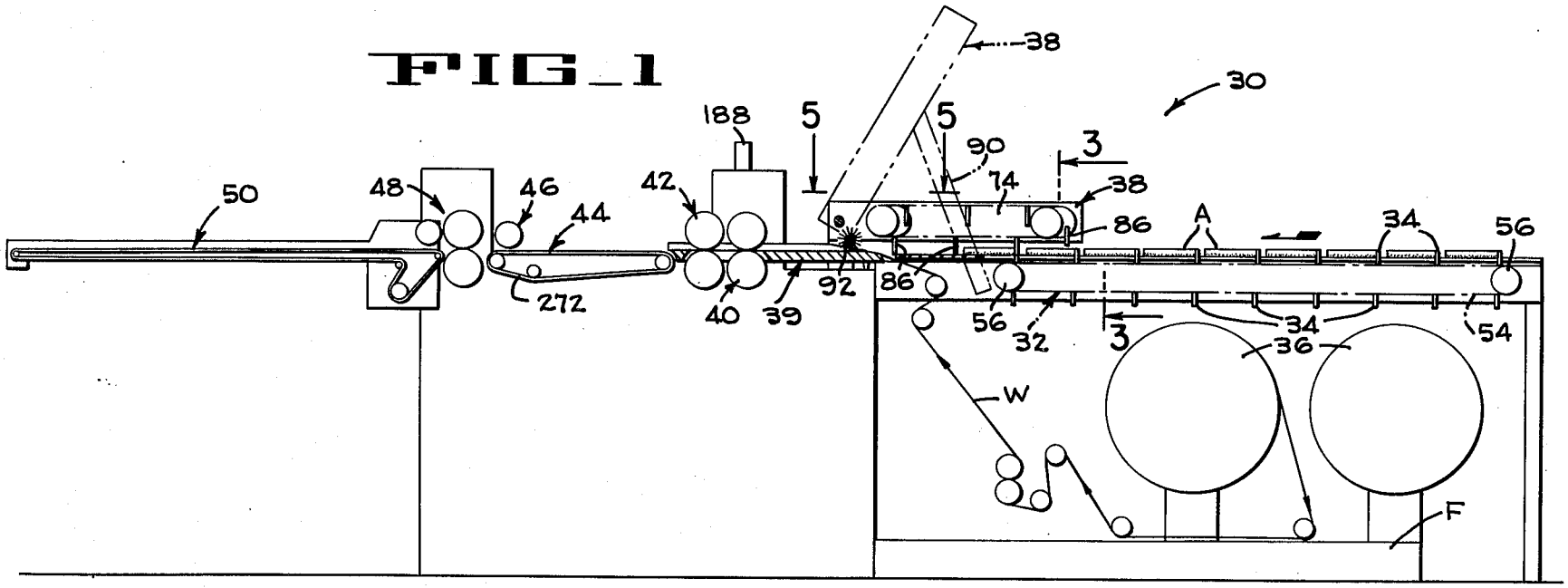
FIG. 1 is a diagrammatic side elevation illustrating the location of the several components of the twin lane wrapping machine.

In order to more easily thread the web W into the web former 39, the overhead conveyor 38 is pivoted about shaft 75 from its lower operative position to its upper position shown in dotted lines in FIG. 1. A latch arm 90 is pivoted at one end to the sub-frame 74 and normally has its other end latched to the frame F to either hold the overhead conveyor 38 in its lower operative position or its upper position. Height adjustment screws 91 (FIG. 3) are threaded in ears of the sub-frme 74 and abut against the frame F to support the input end of the overhead conveyor at the proper height during operation.

A hold down device in the form of a rotary brush 92 (FIG. 5) is secured to an idler shaft 93 journaled on the sub-frame 74 and engages the articles A as they leave the overhead conveyor 38 to stabilize the articles and push them downwardly into the web W as it is being pulled through the web former 39. It will be understood that other types of hold down devices may be substituted for the brush 92. For example, if cheese is to be packaged, the hold down device may be a slide plate.

As illustrated in FIGS. 6–14, the web former 39 is inverted, but otherwise similar to the former illustrated in the aforementioned Gerlach et al U.S. Pat. No. 3,581,457. The web former 39 includes an elongated body 100 having a pair of upwardly opening substantially semi-cylindrical grooves 102, 104 therein for receiving portions of the web W and the two rows of articles A therein. The body 100 is rigidly secured to the frame F by a bracket 106 (FIG. 6) with its input end below the discharge end of the overhead conveyor 38 and brush 92. A pair of slide plates 108 and 110 are firmly clamped against opposite sides of the body by backing plates 112 and 114 and cooperating capscrews.

As progressively illustrated in FIGS. 7–14, the side plates 108 and 110 receive the web W as it moves upwardly along an inclined path over the sloping leading end 118 of the body 100 to first form the web W into a downwardly opening U-shaped trough with the aid of side plate ears 120 and 122. After the articles A have been transferred into the web W in the grooves 102, 104, the side plates are gradually curved over the articles. In this regard, curved portions 124, 126 with convergig edges 128, 130 which cross at 132 (FIGS. 7 and 11) and thereafter diverge to form overlapped portions at 134. The above curvature causes the web to gradually form into a pair of parallel tubes 138, 140 entubing the articles A in the two rows. If the wrapping material is paper, the width of the web is dimensioned so that the edge portion W' and W'' (FIGS. 12 and 26) of the web overlap each other and a central portion W''' a sufficient distance to provide two separated longitudinal seals 142, 144 (FIGS. 25 and 26) with a substantially undisturbed area 146 therebetween. If the web W is of thermosealing material, the width of the web is preferably such that the edge portions Wa and Wb do not overlap each other as indicated in FIG. 27.

As illustrated in FIGS. 7 and 12–15, the upper trailing portions of the side plates 108 and 110 are relieved at 148 and 150 to receive both an upper sealing wheel 152 (FIG. 13) of the longitudinal sealing mechanism 40, and the upper slitting knife or severing wheel 154 (FIG. 14) of the longitudinal sealing mechanism 42. The central portion of the body 100 is likewise relieved at 156 to receive the upper portion of the lower sealing wheel 158 (FIG. 13) of sealing mechanism 40 and the lower severing wheel 162 (FIG. 14).

Figure 16:
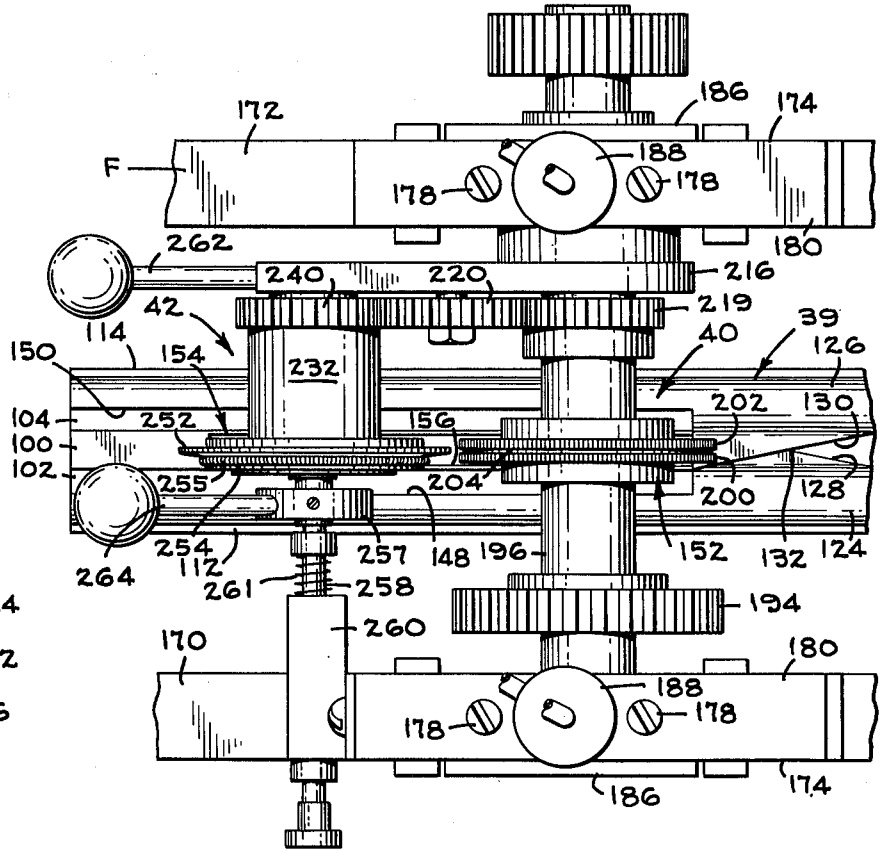
FIG. 16 is a plan of the structure shown in FIG. 15.
Figure 15:
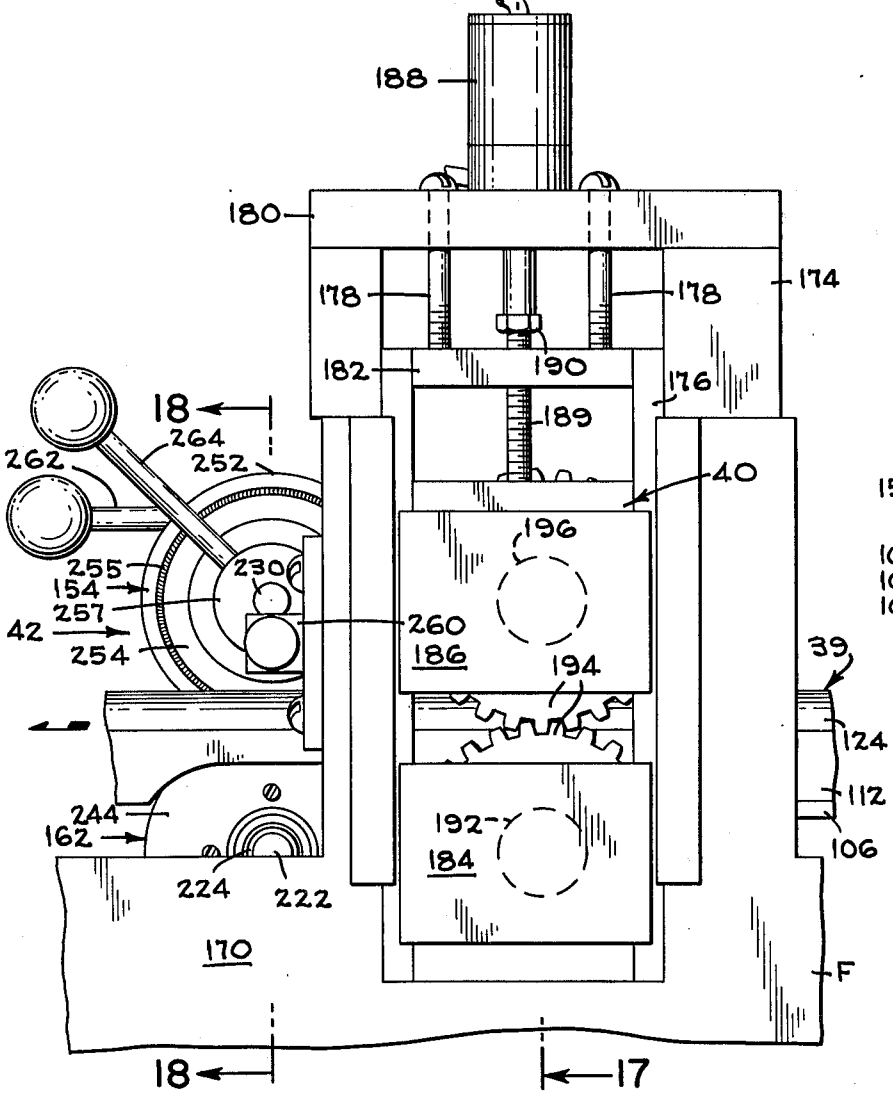
FIG. 15 is an enlarged side elevation looking in the direction of arrows 15—15 of FIG. 2 illustrating the structure for supporting the longitudinal sealing and longitudinal severing mechanisms.
Figure 17:
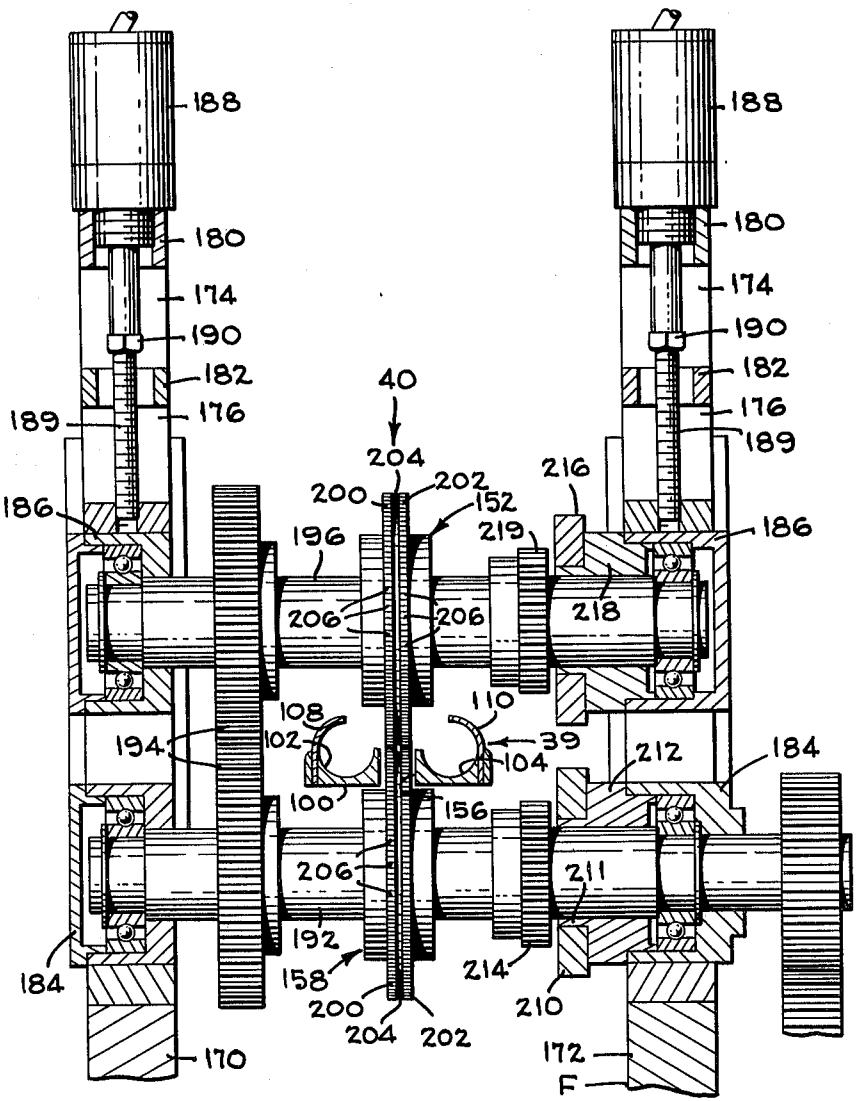
FIG. 17 is a transverse section taken along lines 17—17 of FIG. 15.

Having reference to FIGS. 6 and 15–17, the longitudinal sealing mechanism 40 and the longitudinal severing mechanism 42 are attached to each other and are supported on the frame F as a single unit. As best shown in FIGS. 15–17, the frame F includes a pair of longitudinally extending side walls 170, 172 each of which has a vertical false frame 174 secured thereto defining a rectangular slide way therein that receives a rectangular slide frame 176. The slide frame 176 may be vertically adjusted by capscrews 178 extending through holes in an upper bar 180 of the false frame 174 and threaded in tapped holes in an upper bar 182 of the slide frame 176. A lower bearing block 184 is secured to the slide frame 176 and an upper bearing block 186 is received in the slide frame 176 for vertical movement. Power means such as a pneumatic cylinder 188 is secured to the upper bar 180 of the false frame and has a piston rod connected to the upper bearing block 186 by a threaded connector 189 and locknut 190.

The pair of lower bearing blocks 184 rotatably support a driven lower sealer shaft 192 that is connected by spur gears 194 to an upper shaft 196 journaled in the upper bearing blocks 186 thereby driving the shafts at the same speed and in opposite directions. The aforementioned upper longitudinal sealing wheel 152 is keyed to the upper shaft 196 and is in planar alignment with the lower sealing wheel 158 which is keyed to the lower shaft 192.

As illustrated in FIG. 17, each longitudinal sealing wheel 152, 158 includes a pair of spaced annular sealing surfaces 200, 202 with an annular relieved portion 204 therebetween. The sealing surfaces 200,202 are provided with paper crimping teeth 206 with the teeth in the upper sealing wheel 152 angularly oriented relative to the teeth on the lower wheel to enter the grooves between the teeth in the lower sealing wheel 158. Thus, when the upper sealing wheel 152 is urged downwardly into operative sealing position by the pneumatic cylinders 188, sufficient pressure is applied to the web of paper wrapping material by the mating crimping teeth 206 to break the fibers in the three layers of paper disposed therebetween. The broken fibers then interlock and form the aforementioned parallel longitudinal seals 142, 144 (FIG. 25) in the web thus entubing the articles A in two rows or lanes.

Figure 6:
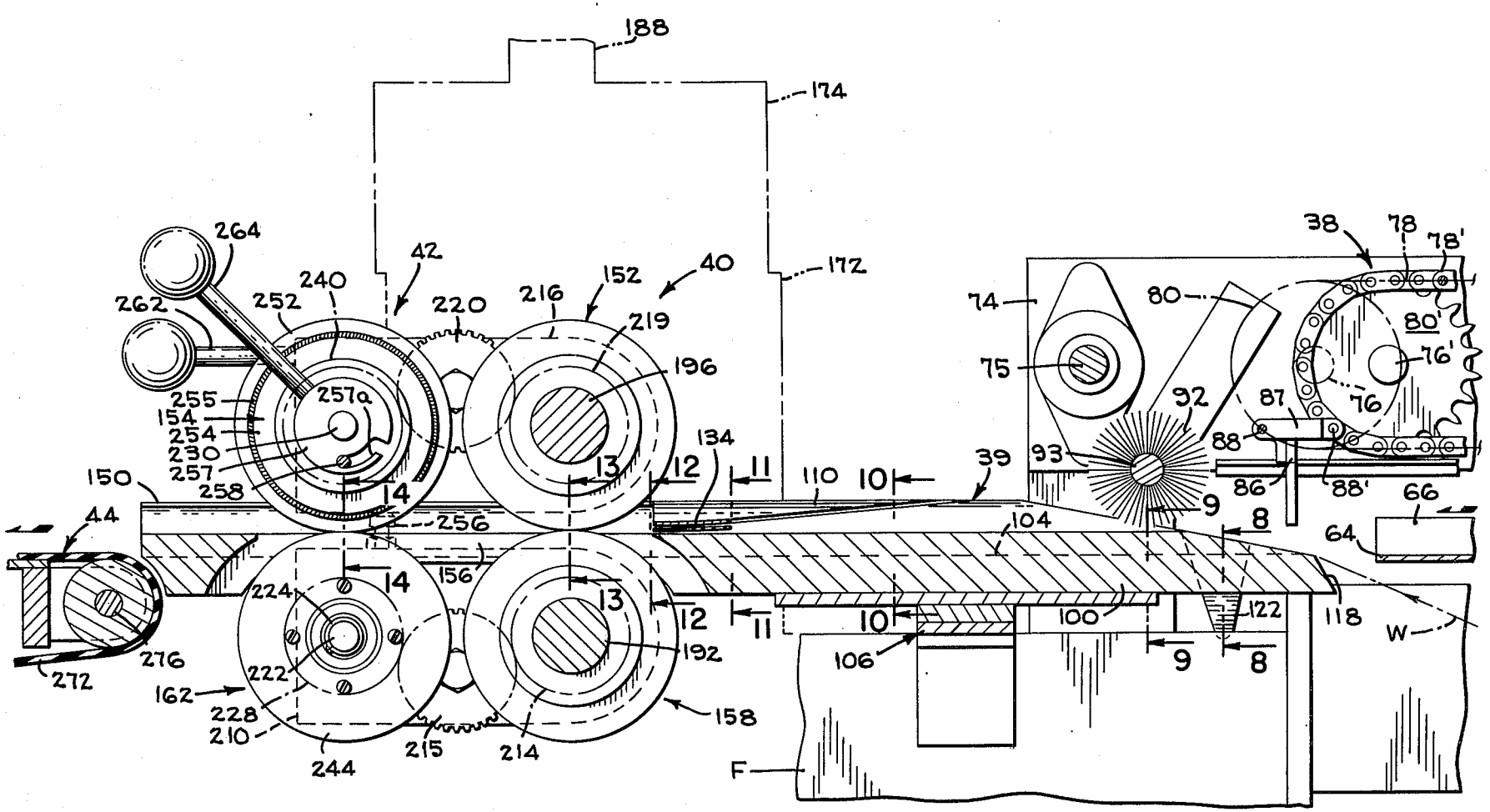
FIG. 6 is an enlarged vertical section taken along line 6—6 of FIG. 2 illustrating the web folding mechanism in relationship with the longitudinal sealing and severing mechanism.
Figures 7, 7A:
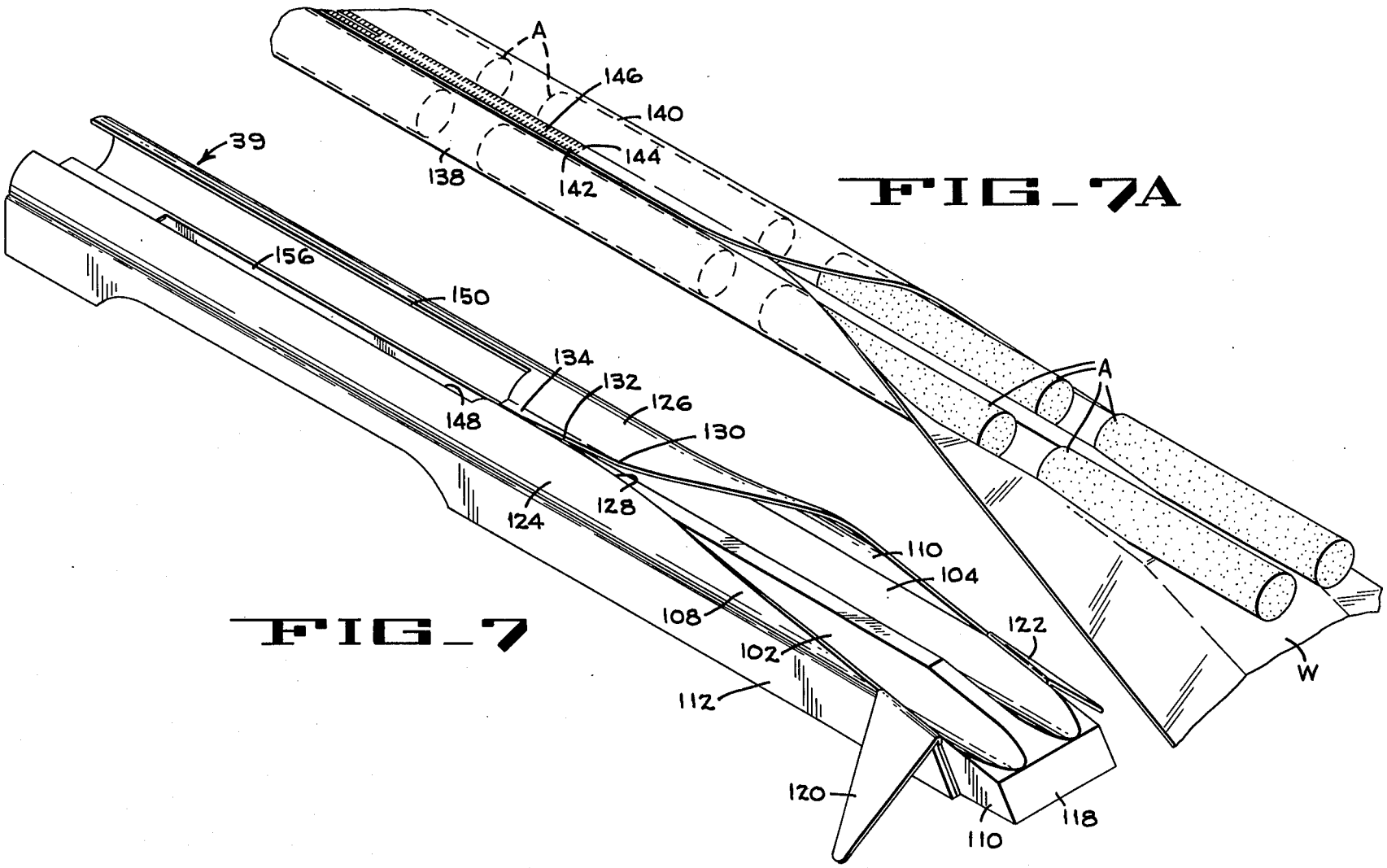
FIG. 7 is an enlarged perspective of the web folding mechanism.
FIG. 7A is a perspective illustrating the manner in which the twin lanes of articles enter the web and the manner in which the web is wrapped around the articles.

The longitudinal severing mechanism 42 (FIGS. 6 and 15–18) includes a lower arm 210 that is rigidly secured on the neck 211 of a sleeve 212 (FIG. 17). The sleeve is rigidly secured to one of the lower bearing blocks 184 and the lower arm 210 projects downstream therefrom as indicated in dotted lines in FIG. 6. A spur gear 214 is keyed to the lower seal shaft 192 and meshes with an idler gear 215 journaled to the arm 210 by a shouldered capscrew. An upper arm 216 is journaled on the neck of a sleeve 218 rigidly secured to one of the upper bearing blocks 186 and projects downstream as best shown in FIGS. 6 and 16. A spur gear 219 is keyed to the upper sealer shaft 196 and meshes with an idler gear 220 that is journaled to the upper arm 216 by a shouldered capscrew. Thus, the lower arm 210 is maintained in a horizontal position at all times whereas the upper arm 216 may be pivoted from the illustrated horizontal position to an upwardly inclined position for reasons which will be described hereinafter.

A stub shaft 222 (FIG. 18) is secured to a flanged portion of the lower arm 210 and has a sleeve 223 journaled thereon and held from axial displacement by a snap ring 224. Gear teeth 228 formed on one end of the sleeve 223 mesh with the idler 215 (FIG. 6) thus driving the sleeve 223 in the same direction and at the same speed as the lower sealer shaft 192. The aforementioned lower severing wheel 162 is bolted to the other end of the sleeve 223. A stub shaft 230 is journaled for pivotal and axial movement in a flanged portion of the upper arm 216 and has a flanged sleeve 232 journaled thereon and held from axial displacement by a snap ring 234. The shaft 230 has a helical groove 236 formed therein which receives one end of a pin 238 that is secured to the upper arm 216. Thus pivotal movement of the shaft 230 in a counterclockwise direction (FIG. 6) causes the shaft 230 and parts supported thereon to move to the right (FIG. 18) into its illustrated severing position. The idler sprocket 220 meshes with gear teeth 240 on the sleeve 232 (FIG. 16) and accordingly the sleeve 232, and the upper slitting knife 154 which is secured to a flanged end thereof, are driven in the same direction and at the same speed as the upper sealing wheel 152.

Figure 18:
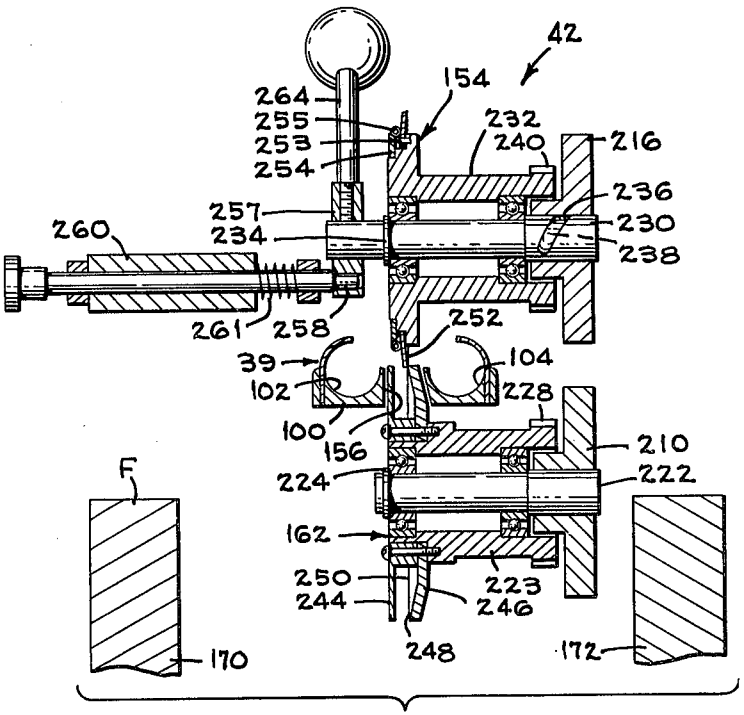
FIG. 18 is a vertical section taken along lines 18—18 of FIG. 15 illustrating the slitting mechanism.
Figure 18A:
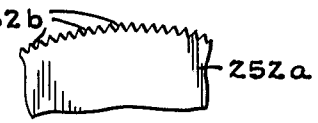
FIG. 18A is an enlarged side view of a modified form of a severing blade of the slitting mechanism, said blade being provided with perforating teeth for perforating the web.

The lower severing wheel 162 acts as a cutting anvil and is of two piece construction comprising a flanged web supporting disc 244 (FIG. 18) and a severing disc 246 having a beveled inner portion 248. The discs 244 and 246 cooperate to define a groove 250 therebetween and provide support for the web being severed. The upper slitting knife 154 includes a circular blade 252 which enters the grooves 250 when in operative severing position and bears against the inner portion 248 of the disc 246 to define a web severing shear. The blade 252 is secured to a flanged portion of the sleeve 232 by a pin 253, a ring 254 removably attached to the flange, and an annular spring 255 which permits flexing of the blade 252. As illustrated, the blade 252 is designed to completely sever the web when in operative position. It will be understood, however, that the periphery of an alternate form of the blade **252*a* (FIG. 18A) may include teeth 252*b* that are vertically adjusted relative to the lower wheel 162** to either perforate or completely cut through the web.

As previously described, the upper arm 216 is mounted for pivotal movement about the axis of the upper shaft 196. An adjustable stop 256 is secured to the lower arm 210 and limits downward pivotal movement of the upper arm 216, thus permitting the elevation of the blade **252*a* (FIG. 18A) to be easily changed between its perforating and complete severing positions. A collar 257 (FIGS. 6 and 18) is rigidly connected to the free end of the upper shaft 230 and has an arcuate slot 257*a* with a radial inlet portion which is adapted to receive the free end of the lock pin 258 when in its lowered operative web severing position. The pin 258 is the operative component of a spring loaded quick release latch 260 that is bolted at the desired height to the frame F as shown in FIGS. 15 and 16. The latch 260 may be disengaged from the slot 257*a* by pulling the pin 258 away from the collar 257 against the urging of a spring 261.**

manually operated levers 262 and 264 with balls on their ends are secured to the upper arm 216 and the collar 257, respectively, to aid the operator in pivoting the upper slitting knife 154 between a lower operative shearing position, and an upper raised inoperative position. When the lever 264 (FIG. 6) is pivoted to a position where the radial inlet of the slot **257*a* is aligned with pin 258, the pin 238 (FIG. 18) will ride along the helical groove 236 thus moving the upper severing blade 252 to the left (FIG. 18) so that it will not engage any portion of the lower wheel 162** when moving into or out of the severing position.

After the two rows of articles have been entubed in the web or wrapping material by the longitudinal sealer 40; and the web has moved past the longitudinal severing mechanism 42 in an unsevered, perforated, or completely severed condition, the two lanes of entubed articles are moved onto the transfer conveyor 44 (FIG. 1). The transfer conveyor 44 includes an endless belt 272 which supports the two lanes of articles and advances them into the transverse cutter and sealer 48. The endless belt is trained around pulleys on drive shaft 274 (FIG. 20) and driven shaft 276 (FIG. 6) and is driven about 15 per cent faster than the linear speed of the web thereby sliding under the web and maintaining the web tight. The driven pressure wheel 46 is disposed over the central portion of the web adjacent the discharge end of the transfer conveyor 44 and includes arcuate peripheral surfaces 278 (FIG. 22) for maintaining contain of the twin tubes so that they remain in the proper path immediately before entering the transverse cutting and sealing mechanism 48.

Figure 19:
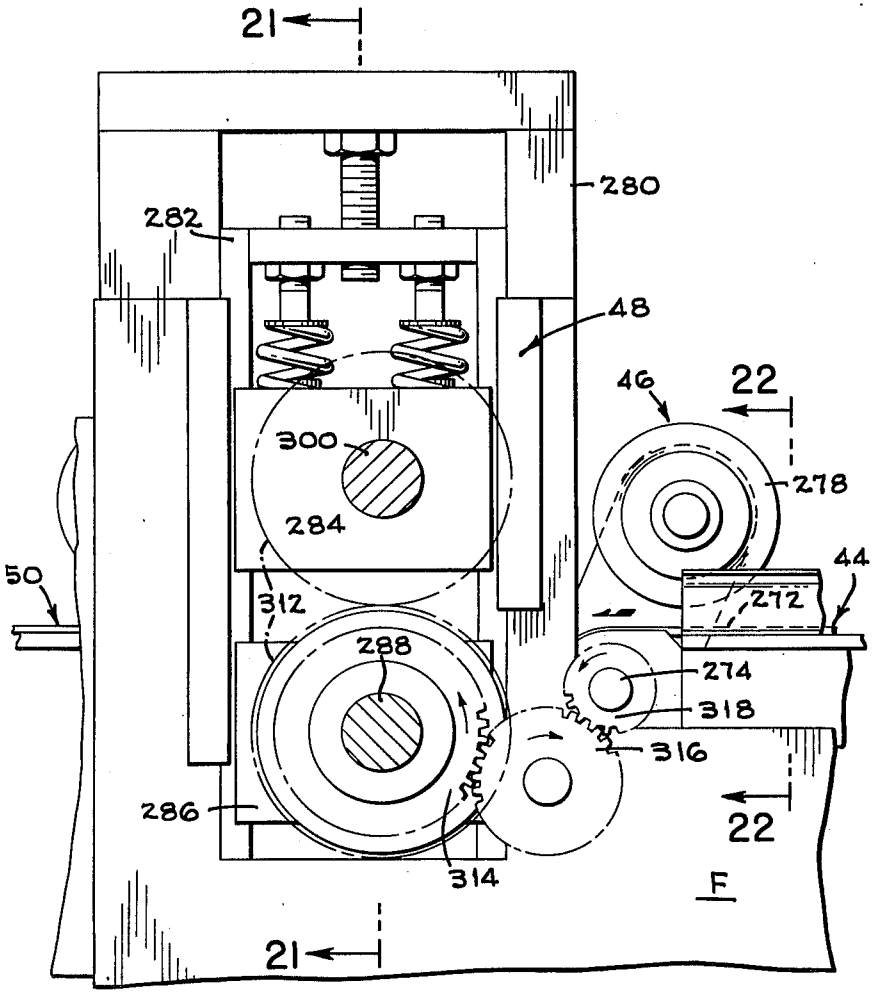
FIG. 19 is an enlarged side elevation of a rotary transverse cutting and sealing mechanism.

The transverse cutting and sealng mechanism 48 (FIGS. 19–21) is mounted on the main frame F by a false frame 280, a slide frame 282, and pairs of upper and lower bearing blocks 284, 286 all of which are substantially the same as the previously described structure for mounting the longitudinal sealer 42 except that the pneumatic cylinders are omitted. A driven lower shaft 288 is journaled in the lower bearings 286 and has a pair of diametrically opposed lower crimping heads 290 secured thereto between flanges 291. The arcuate web contacting surfaces 292 of the heads have centered transverse cutter receiving grooves 294 therein. The arcuate surfaces 292 also have paper crimping teeth 296 therein. In order to support the entubed articles as they move through the mechanism 48, product supporting shoes 298 (FIG. 20) are secured to the shaft 288 at points disposed between the crimping heads 290 and have arcuate surfaces that are tangent to the plane of the article supporting run of the transfer conveyor 44 when in article supporting position.

An upper shaft 300 supports a pair of upper crimping heads 302 each having a transversely extending cutter 304 therein and arcuate crimping surfaces with crimping teeth 306 (FIG. 21A) on both sides of the cutters 304. The upper heads include flanges 308 having annular rings 310 (FIG. 21) secured thereto which guide on the outer surfaces of the loer flanges 291 to assure axial alignment of the upper and lower heads.

The driven lower shaft 288 is connected in driving engagement with the upper shaft 300 by a pair of mating gears 312 which are secured to the shafts with the cutters 304 aligned with the associated cutter grooves 294, and with the crimping teeth 299 and 306 entering the grooves of the cooperating crimping surfaces. A spur gear 314 (FIG. 19) secured to the lower shaft 288 drives an idler gear 316 which in turn meshes with a gear 318 keyed on the drive shaft 274 (FIGS. 19 and 22) of the conveyor 44. A gear 319 on the other end of the shaft 274 meshes with a gear 320 on a shaft 321 to which the pressure wheel 46 is secured. Thus, driving of the lower shaft 288 of the mechanism 48 through a magnetic clutch 324 drives the conveyor 44, the pressure wheel 46 and the transverse sealing mechanism 48 in timed relation.

The transverse cutting and sealing mechanism 48 transversely seals the web between the articles by causing the teeth 299, 306 to intermesh thereby breaking and interlocking the fibers in the paper. As the cutter moves tangentially downward, it enters the cutter receiving groove 294 thereby transversely severing the package from the web. It will be understood that one or both of the transverse cutters 304 may be provided with perforating teeth 325 (FIG. 21A) to perforate rather than completely sever the web transversely. Similarly one or both of cutters 304 may be completely removed if it is desired to perforate or completely cut every second transverse sealed area, or to provide an uncut string of packages.

The individual packages received from the transverse cutting and sealing mechanism 48 are transferred to the driven delivery conveyor 50 which discharges the packages P from the machine.

In operation the several components of the twin lane wrapping machine 30 of the present invention are driven in timed relation in the direction of the arrows in the drawings by well known drive means with certain components being similar to the type of drive means disclosed in the aforementioned Aterianus application. Although the transverse cutting and sealing mechanism 48 of the preferred embodiment has been sized to handle articles of a particular size at constant velocity, it will be understood that the Aterianus drive is capable of providing a variable drive to enable varying the web feed per cycle. The Aterianus drive also is capable of adjustably modulating the speed of the transverse cutting and sealing mechanism during each cycle to enable the mechanism 48 to match the web velocity.

The web W (FIG. 1) in the illustrated preferred embodiment of the invention is thin paper which is continuously drawn upwardly from a roll 36 and is threaded through the web former 39. Simultaneously therewith, the pushers 34 of the main conveyor advance spaced pairs of articles A under and into engagement with pusher plates 86 on the overhead conveyor 38 which advance the articles into supporting engagement on the web. The rotary brush 92 (FIG. 4) then forces the two rows of articles A and the web W into grooves in the former 39 which holds the longitudinal edges W′,W″ (FIGS. 12 and 26) over a central portion W‴ of the web W. The sealing wheels 152 and 158 of the rotary longitudinal sealing mechanism 40 then firmly engage the longitudinal edges and central portion of the web with sufficient force (applied by pneumatic cylinder 188) to break and interlock the paper fibers in the web W to provide a pair of longitudinal seals.

Figure 20:
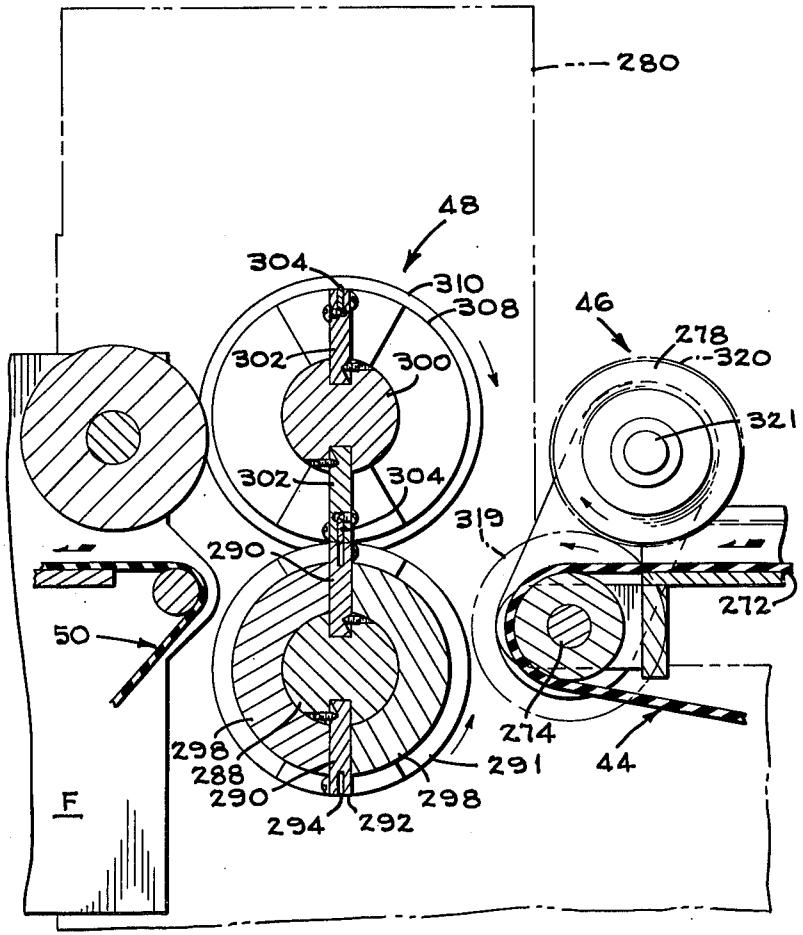
FIG. 20 is an enlarged vertical section taken along lines 20—20 of FIG. 2.

Depending upon what type of finished packages are desired, the longitudinal severing mechanism 42 (FIG. 6) may be either: deactivated so as not to longitudinally sever the web, activated to perforate the web to provide a longitudinal tear strip, or activated to completely sever the web. The web with the entubed articles A therein is advanced by the transfer conveyor 44 and pressure wheel 46 into the transverse cutting and sealing mechanism 48 (FIG. 20). The transverse sealing and severing mechanism 48 includes two cooperating pairs of sealing and severing heads which transversely seal articles in pockets in the web by breaking and interlocking the paper fibers. The seal areas may then be transversely severed completely through, may only be perforated, or may not be severed as desired.

If individual packages P (FIG. 23) containing a single article, or pairs of side-by-side interconnected packages containing either single or a pair of side-by-side articles (FIG. 24) are desired, a transverse cutting blade 304 is provided in each cutting head. If it is desired to package two longitudinally spaced articles in separate compartments in a single package, or two longitudinally spaced articles and two laterally spaced articles each in separate compartments in a single package (FIG. 25) then one of the cutting blades 304 is either removed or is adjusted to merely perforate the transverse seal areas. If it is desired to strip package either single rows of articles each in separate compartments, or double rows of articles each in separate compartments, then both cutting blades 304 are removed or are adjusted to merely perforate the transverse seal areas. In any of the above situations, it will be understood that the transverse cutting blades with perforating teeth may replace the illustrated full severing blade to transversely perforate the web thereby providing transverse tear strips T′ (FIG. 25).

If thermosealing wrapping material or wrapping material with glued edges and transverse seal areas, rather than paper, is to be used, heaters are placed in the longitudinal and transverse sealers in a manner well known in the art to provide the requisite heat for sealing the web.

From the foregoing description it is apparent that the wrapping machine and method of the present invention moves spaced rows of articles onto a web of wrapping material which moves upwardly under the articles and thereafter supports the articles. The longitudinal edge portions of the web are then folded over the central portion to longitudinally seal and entube the two rows of articles with the articles acting on mandrels. The central portion of the web may then be longitudinally perforated, longitudinally cut completely through, or may not be acted upon by longitudinal severing mechanism depending upon the particular end product desired. Thereafter, the web is transversely sealed between articles to define individual product filled pouches. The transverse seal area may selectively remain unsevered or transversely perforated if strip packaging is desired, may be alternately transversely perforated, and completely severed if transverse tear strips are desired in double length packages, or may be completely severed transversely depending upon the type of finished product desired.

Although the best mode contemplated for carrying out the present invention has been herein shown and described, it will be apparent that modification and variation may be made without departing from what is regarded to be the subject matter of the invention.

What we claim is:

1. A method of packaging articles comprising the steps of moving a web of packaging material having a longitudinal intermediate portion and edge portions along a path, moving a pair of spaced articles along spaced parallel paths onto the web for movement therewith, folding the web around the articles with the longitudinal edge portions disposed between the articles, longitudinally sealing the edge portions to the intermediate portion for encompassing each article in a tube of packaging material, transversely sealing the tubes to confine the articles therein, a plurality of pairs of longitudinally and transversely spaced articles are moved onto the web to define two continuously moving rows of spaced articles, transversely severing article filled and sealed packages from the tubes, the material is longitudinally severed prior to being transversely sealed and severed, and additionally applying tube holding and separating pressure, on the sealed and severed edge and intermediate portions of a web for maintaining the entubed articles in their spaced parallel paths.

2. A method of packaging articles in a web of light paper packaging material that is longitudinally and transversely sealed by longitudinal and transverse sealers having toothed sealing surfaces comprising the steps of moving a web of packaging material having longitudinal edge portions along a path, moving articles into engagement with the web for movement therewith, folding the web around the articles with the longitudinal edge portions overlapping, longitudinally sealing the overlapping edge portions for encompassing each article in a tube of packaging material by squeezing the edge portions between the toothed sealing surface of the longitudinal sealer with sufficient pressure to break and interlock the fibers in the paper, and transversely sealing the ends of the tube to confine the articles therein by squeezing the tube between toothed sealing surfaces of the transverse sealer with sufficient force to break and interlock the end fibers in the paper.

3. A method of packaging articles in a web of light paper packaging material that is longitudinally and transversely sealed by rotary longitudinal and transverse sealers having toothed sealing surfaces comprising the steps of moving a web of packaging material having a longitudinal intermediate portion and edge portions along a path, moving a pair of spaced articles along spaced parallel paths onto the web for movement therewith, folding the web around the articles with the longitudinal edge portions disposed between the articles, longitudinally sealing the overlapping edge portions to the intermediate portion for encompassing each article in a tube of packaging material by squeezing the edge and intermediate portions between the toothed sealing surfaces of the longitudinal sealer with sufficient pressure to break and interlock the fibers in the paper, and transversely sealing the ends of each tube to confine the articles therein by squeezing the tubes between toothed sealing surfaces of the transverse sealer with sufficient force to break and interlock the end fibers in the paper.

4. A method according to claim 3 and additionally comprising the step of longitudinally severing the material between each tube prior to sealing the ends of the tubes.

5. A method according to claim 4 wherein a plurality of pairs of longitudinally and transversely spaced articles are moved onto the web to define two continuously moving rows of spaced articles, and additionally including the step of transversely severing article filled and sealed packages from the tubes.

6. A method according to claim 5 wherein the material is longitudinally severed prior to being transversely sealed and severed, and additionally applying a holding and tube separating force on the sealed and severed edge and intermediate portions of the web for maintaining the entubed articles in their spaced parallel paths.

7. A method according to claim 3 and additionally comprising the step of transversely severing the filled tubes to form dual compartmented package.

8. A method according to claim 4 and additionally comprising the step of transversely severing the filled tubes to form a pair of article filled packages.

9. A method according to claim 3 wherein the longitudinal sealing step applies a pair of spaced parallel strips of broken and interlocked fibers with an unsqueezed strip therebetween in the edge and intermediate portions of the web, and longitudinally severing the material between each tube in the unsqueezed strip to provide a tube edge that is less apt to be torn.

10. A method according to claim 3 wherein said folding step folds the web around the articles with the longitudinal edge portions overlapping and disposed between the articles.

11. An apparatus for packaging articles in a web of packaging materials having a longitudinal intermediate portion and longitudinal edge portions comprising; means for continuously moving the web along a path, means for moving pairs of spaced articles along two spaced parallel rows onto the web for movement therewith, folding means for receiving and folding the continuously moving web around the articles in each row of articles with the longitudinal edge portions disposed between the articles, said folding means comprises an elongated body having a first portion formed with parallel article receiving grooves of progressively greater peripheral dimension in order to gradually fold the web around the articles, and another portion centrally slotted to provide an opening, and driven rotary means for longitudinally sealing the edge portions to the intermediate portions of the web for encompassing each row of articles in a tube of packaging material, said longitudinal sealing means being located in said centrally slotted portions of said rail.

12. An apparatus according to claim 11 and additionally comprising driven rotary severing means also located in said slotted portion for longitudinally severing the material between each tube prior to being transversely sealed.

13. An apparatus for packaging articles in a web of packaging material having a longitudinal intermediate portion and longitudinal edge portions comprising; means for continuously moving the web along a path, means for moving pairs of spaced articles along two spaced parallel rows onto the web for movement therewith, folding means for receiving and folding the continuously moving web around the articles in each row with the longitudinal edge portions disposed between the articles, driven rotary means for longitudinally sealing the edge portions to the intermediate portion of the web for encompassing each row of articles in a tube of packaging material, and driven rotary transverse sealing means for thereafter transversely sealing the tubes with at least one article in each tube between adjacent transverse seals, said packaging material is a web of light paper, said rotary longitudinal sealing means comprising a pair of toothed sealing wheels disposed on opposite sides of the web and squeezing the edge and intermediate portions of the web with sufficient force to break and interlock and fibers in the paper between the tubes thereby providing a longitudinal seal.

14. An apparatus according to claim 13 and additionally comprising driven rotary severing means for longitudinally severing the material between each tube prior to being transversely sealed.

15. An apparatus according to claim 14 wherein said pair of toothed wheels are each circumferentially grooved to provide two spaced longitudinal seal strips with an undeformed portion therebetween.

16. An apparatus according to claim 15 wherein said rotary longitudinal severing means severs the web in said undeformed portion.

17. An apparatus according to claim 13 wherein said folding means causes said edge portion to overlap each other.

18. An apparatus according to claim 14 wherein said rotary severing means includes a rotary anvil wheel having wall means defining a blade receiving groove in its periphery, a rotary web severing blade, means mounting said rotary blade for movement between a web severing position in said groove against one wall thereof and a position spaced from the web, means for moving said blade axially away from said wall prior to moving the blade into said groove, and means for latching said blade in web severing position.

* * * * *